US005328129A

United States Patent [19]

Gray

[11] Patent Number: 5,328,129

[45] Date of Patent: Jul. 12, 1994

[54] GUIDANCE METHOD FOR UNTHROTTLED, SOLID-FUEL DIVERT MOTORS

[75] Inventor: Roger L. Gray, King George, Va.

[73] Assignee: The United States of America as represented by the Secretary of the Navy, Washington, D.C.

[21] Appl. No.: 77,798

[22] Filed: Jun. 17, 1993

[51] Int. Cl.[5] ..... F41G 7/00

[52] U.S. Cl. ..... 244/3.15

[58] Field of Search ..... 244/3.1, 3.15, 3.2, 244/3.16, 3.19, 3.22

[56] References Cited

U.S. PATENT DOCUMENTS

| | | | |
|---|---|---|---|
| 4,541,591 | 9/1985 | Chadwick et al. | 244/3.15 |
| 4,568,040 | 2/1986 | Metz | 244/3.22 |
| 4,750,688 | 6/1988 | Davies | 244/3.11 |
| 5,064,141 | 11/1991 | Nesline, Jr. | 244/3.15 |
| 5,071,087 | 12/1991 | Gray | 244/3.15 |
| 5,082,200 | 1/1992 | Gray | 244/3.15 |

*Primary Examiner*—Ian J. Lobo

*Attorney, Agent, or Firm*—John D. Lewis; Jacob Shuster

[57] ABSTRACT

A method is provided for guiding an in-flight vehicle having course divert capability toward an intercept with a target. Using a sensing device mounted on the vehicle, target data is acquired to establish a relative position vector between the vehicle and the target. A trajectory course for the vehicle is selected such that it is offset from a collision course with the target. The offset is defined within in a target impact plane perpendicular to the relative position vector. The total thrust of the vehicle associated with its course divert capability is directionally controlled through first and second orthogonal components. To reduce offset the second component is directed to cause the trajectory of the vehicle to spiral around the relative position vector.

10 Claims, 2 Drawing Sheets

GUIDANCE METHOD FOR UNTHROTTLED, SOLID-FUEL DIVERT MOTORS

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention relates generally to in-flight guidance methods, and more particularly to a guidance method useful in conjunction with unthrottled, solid-fuel divert motors and/or passive range estimation techniques.

BACKGROUND OF THE INVENTION

Numerous guidance laws have been developed for guiding missiles that use liquid-fuel divert motors during the missile's intercept phase of flight. Unfortunately, liquid fuel is quite toxic and is therefore unsafe in many stowage, handling and operation applications. Solid fuel, on the other hand, is relatively safe. The primary disadvantage of solid-fuel divert motors is that each burn imparts a thrust of a predetermined magnitude. Unlike a liquid fuel, once a solid fuel is ignited, the magnitude and duration of the burn is difficult to alter. This poses a significant constraint on the capability of the vehicle and the design of the guidance law. One guidance method specifically designed for solid-fuel divert motors is addressed in applicant's patent entitled "Method of Guiding an In-Flight Vehicle Toward a Target", U.S. Pat. No. 5,082,200, issued Jan. 21, 1992, the disclosure of which is hereby incorporated by reference. However, such approach is restricted to vehicles with predefined, discrete solid fuel burns (i.e., diverts) separated by coasting periods. Construction of vehicles with such predefined flight scenarios is complex and therefore costly.

Further, in certain types of intercept scenarios, it is necessary for a kill vehicle (i.e., the payload of a missile, commonly referred to as a KV, that actually intercepts a missile or satellite) to accurately know target range during homing. Target range may be necessary for fuzing and/or for the computation of the gains used in the KV's guidance techniques.

Some conventional KVs explicitly measure range with laser or radar range-finding sensors. This solution, however, has drawbacks. It requires an extra device to be installed on the KV, which increases the KV's size, weight, complexity and power requirements. In addition, the range-finding device may not work in high-velocity space intercepts. In a highvelocity intercept (e.g., relative velocity greater than 2 kilometers per second), the target range is relatively large (e.g., tens of kilometers) until seconds prior to the intercept. Since active range-finding sensors ping a signal off the target, at long range the return signal may be too weak to receive and process. Consequently, the active range-finding device may be inoperable during most of homing.

Fortunately, range can be determined without direct measurement. If the KV uses an optical sensor to explicitly measure the direction to the target, target range can be determined geometrically via triangulation. To do this, the KV intentionally flies an offset trajectory—a trajectory that, if projected through time, would miss the target. By flying this offset trajectory, the relative geometry of the KV and the target changes over time—in a sense, giving the KV a stereoscopic image of the target. As the KV approaches the target, divert motors (rockets) or aerosurfaces turn the KV onto a collision course.

Conventional guidance techniques, such as proportional navigation, do not direct the KV along an offset trajectory as they try to achieve a collision course as soon as possible. Consequently, these guidance techniques are not suitable for passive range estimation (passive because an optical sensor does not send an active signal that pings off the target). For passive range estimation, the shape of the offset trajectory is important. The simplest offset trajectory is an arc lying in a single plane. In this trajectory, the KV is initially offset from the intercept trajectory. As the KV approaches the target, the magnitude of this offset decreases monotonically to zero. By adding a zig-zag or spiral to this trajectory, the target range becomes more observable.

In the prior art, two guidance techniques have been proposed for passive range estimation. The first of these is known as the "maximum-information" guidance technique disclosed by D. G. Hull and J. L. Speyer in "Maximum-Information Guidance for Homing Missiles," AIAA Journal of Guidance Control and Dynamics, Vol. 8, No. 4, July–August 1985, pp. 494–497. The second of these techniques is known as the dithered, proportional-navigation guidance technique disclosed by David V. Stallard in "An Angle-Only Tracking Filter for a Maneuvering Target," Conference Proceedings of AIAA Guidance, Navigation and Control Conference, 1990.

The maximum-information guidance technique directs the KV in a 2-dimensional zig-zag trajectory to the target. In other words, if the intercept is observed in a Cartesian frame centered at the target, the KV follows a zig-zag flight path that lies in a single plane. To compute this trajectory, the KV must solve an optimization problem requiring computational resources not typically available from a conventional KV guidance computer. Thus, the computational requirements of the maximum-information guidance technique make its realization unlikely for current missile technology. Furthermore, to keep the optimization problem manageable, the intercept trajectory is constrained to lie in a 2-dimensional plane thereby excluding other, possibly more optimal, 3-dimensional trajectories.

The dithered, proportional-navigation guidance technique directs the KV in a 3-dimensional spiral trajectory. This guidance technique simply rotates the KV thrust about the line-of-sight axis at a fixed, predetermined angular rate. Superimposed on this thrust is the thrust commanded by the conventional proportional-navigation guidance technique. Since the thrust requirements of the proportional-navigation guidance technique are not known in advance, the KV must have enough thrust to cover any possible scenario. Extra thrust, i.e., thrust capability not required in a given scenario, is throttled. While this may be acceptable for KVs equipped with liquid-fuel divert motors, a KV equipped with an unthrottled solid fuel divert motor cannot be guided in accordance with the dithered, proportional-navigation guidance technique.

SUMMARY OF THE INVENTION

Accordingly, it is an object of the present invention to provide a guidance method that is operable with a single, unthrottled solid-fuel divert motor that burns continuously once ignited.

Another object of the present invention is to provide a guidance method that supports passive range estimation.

Yet another object of the present invention is to provide a guidance method that is computationally simple thereby minimizing computational resource requirements.

Other objects and advantages of the present invention will become more obvious hereinafter in the specification and drawings.

In accordance with the present invention, a method is provided for guiding an in-flight vehicle having course divert capability toward an intercept with a target. Using a sensing device mounted on the vehicle, locational data target is acquired to establish a relative position vector between the vehicle and the target. A course for the vehicle is selected such that it is offset from a collision course with the target. The offset is defined as a vector originating from the target and lying in a plane perpendicular to the relative position vector. The vector originating from the target has a magnitude based on the vehicle's total course divert capability. The total thrust is directed in accordance with first and second orthogonal components. The first component is parallel and opposite to the offset to reduce same. The second component is directed to cause the vehicle to spiral around the relative position vector.

DETAILED DESCRIPTION OF THE INVENTION

The present invention will find particular use in guiding an in-flight vehicle (e.g., kill vehicle or KV) equipped with a single, solid-fuel divert motor for intercept with a target. However, it is difficult to describe and conceptualize the present guidance method in an absolute reference frame in which both the target and KV are moving. To simplify the description, a target centered reference frame will be used.

Figure 1:
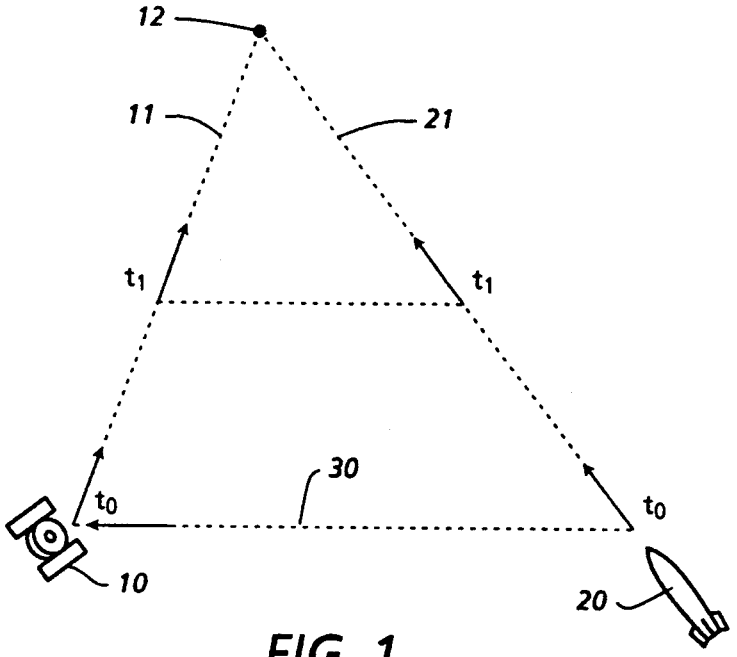
FIG. 1 depicts an absolute reference frame intercept geometry.

Referring now to the drawings and more particularly to FIG. 1, the absolute reference frame intercept geometry associated with a KV 20 is shown during its terminal homing phase of flight. The terminal homing phase begins at time $t_O$when KV 20 acquires data a target 10 and establishes a relative position vector 30 to target data 10. Target acquisition may be accomplished with a sensing device (not shown) mounted onboard the KV 20. Since the guidance method of the present invention is to support passive ranging, the sensing device need only be a passive sensing device, such as an optical sensor, as is well known in the art. At time $t_1$, target 10 is traveling on target trajectory 11 while KV 20 is shown projected on a collision course 21 towards an ultimate collision point 12. This absolute reference frame intercept geometry can be simplified by proper selection of the reference frame.

Figure 2:
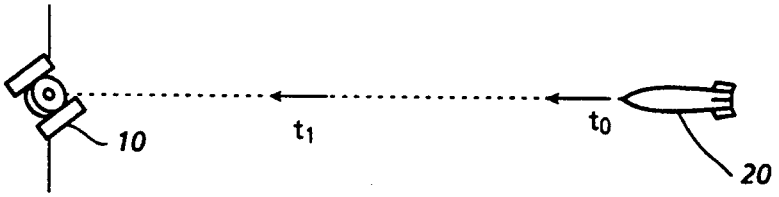
FIG. 2 depicts a target centered reference frame intercept geometry.

Relativity asserts that a frame with moving but nonaccelerating origin (or more specifically, not accelerating over and above the effects of gravity) is no different than a frame with origin at rest, i.e., both frames are inertial. Thus physical phenomena, such as the interception of target 10 by KV 20 can be expressed in either frame with equal validity. Consequently, if target 10 is non-maneuvering, target 10 can be selected as the origin of the reference frame. By choosing the reference frame in this way (i.e., by fixing the position of target 10 at the origin) the intercept problem is simplified since target 10 is no longer moving. Such a target centered reference frame is shown in FIG. 2. Note, however, that this frame is introduced strictly for heuristic reasons and that the present invention can be used with maneuvering targets.

The guidance technique of the present invention has two distinct features:

1) The KV's flight path is intentionally offset from the collision course. The magnitude of this offset is based on the KV's total divert capability and other considerations, such as the target's ability to maneuver and the accuracy of the KV's estimate of target position and velocity.

2) All extra thrust over and above that required to maintain the intentional offset is used to induce a spiral in the KV trajectory.

Intentional Offset from the Target

The intentional offset commanded by the present method is related to the KV's ability to divert its trajectory. Such divert capability may be developed by a single, solid-fuel divert motor or a liquid-fuel divert motor. Alternatively, the KV's ability to divert its trajectory may be developed by control or aero surfaces on the KV. For purposes of illustration, a single, solid-fuel divert motor will be assumed.

The KV's ability to divert its trajectory, or change its projected miss, is a function of its acceleration capability, $A_{KV}(t)$, and the time remaining before impact (or closest approach, if it misses). Letting $t_c$ denote the current time and $t_f$ denote the final time (the time at closest approach), the KV's total divert capability (or MAX DIVERT) is simply the double integral of the KV's acceleration capability from time $t_c$ to time $t_f$:

$$\text{MAX DIVERT} = \int_{t_c}^{t_f}\int_{t_c}^{T} A_{KV}(t)\,dt\,dT \tag{1}$$

Figure 3:
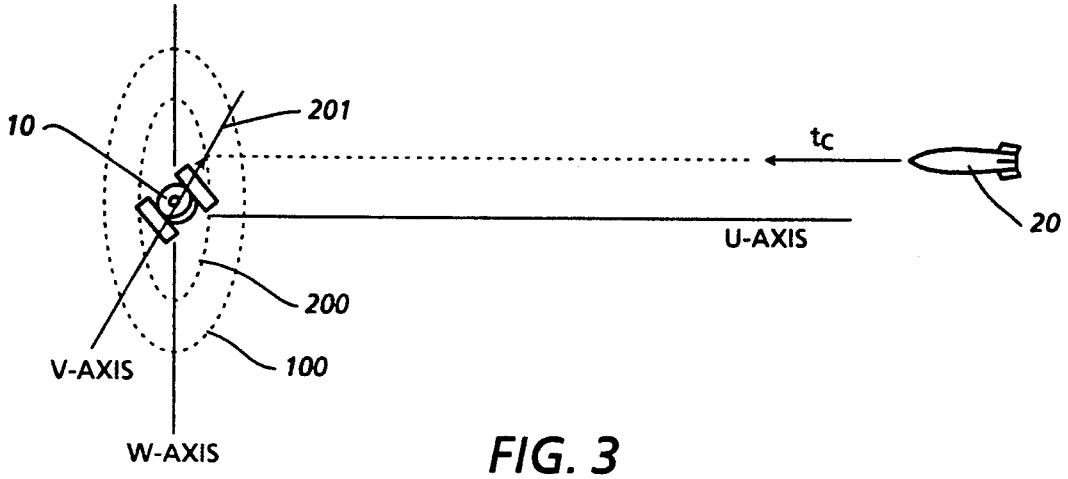
FIG. 3 depicts a 3-dimensional view of the maximum divert capability for a KV-target scenario depicted in a target centered reference frame intercept geometry.

At any time during the terminal homing phase, if the KV's intentional offset is ever larger than MAX DIVERT, the KV will not have enough divert capability to bring itself onto an ultimate collision course. Accordingly, the intentional offset of the KV must always be less than MAX DIVERT. This situation is shown graphically in FIG. 3 for an instant in time $t_c$. MAX DIVERT circle 100 and intentional offset circle 200 are defined in the V-W plane. Based on the current trajectory of KV 20, a projected miss vector 201 extends to the point on intentional offset circle 200 that KV 20 is currently heading.

It would be risky to ever let intentional offset circle 200 coincide with MAX DIVERT circle 100. If target 10 maneuvered slightly, or if target 10 was not exactly where KV 20 thought it was, intentional offset circle 200 could subsequently exceed the MAX DIVERT capability and KV 20 would miss target 10. Therefore, the instantaneous intentional offset (at time t) commanded by the present method must be less than MAX DIVERT or $$\text{Intentional offset}(t) = f(t) * \text{MAX DIVERT}(t) \quad (2)$$

where t is any given time during homing and f(t) is some function such that $$0 \leqq f(t) < 1 \quad (3)$$

Since only the magnitude (and not the direction) of the intentional offset is important, intentional offset circle 200 is centered in the V-W impact plane at target 10.

The value of f(t) could be based of how much the target could maneuver or the accuracy of the KV's estimate of target position and velocity. If the target maneuvers significantly or if the KV's target position and velocity estimates are inaccurate, the intentional offset must be relatively small to insure an intercept. In an actual implementation, f(t) would be based on considerations specific to the KV and its mission. Consequently, the value of f(t) is not specifically addressed in this patent.

Creating the Spiral

As KV 20 approaches target 10, the magnitude of intentional offset circle 200 must decrease and reduce to zero just prior to interception. To do this, KV 20 must divert parallel and opposite to projected miss vector 201. This requires some, but not all, of the KV's total divert thrust. The extra divert thrust is used to spiral KV 20.

Figure 5:
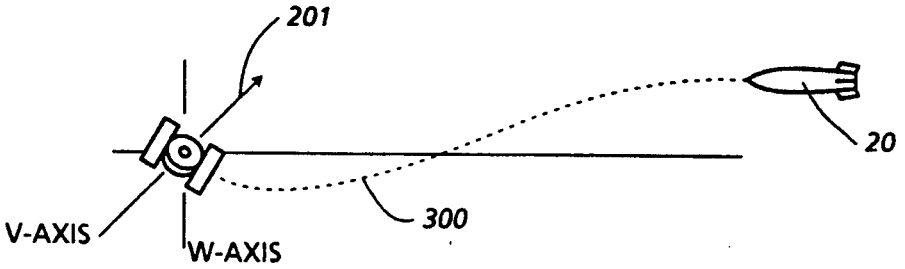
FIG. 5 depicts a 3-dimensional, time lapse scenario showing how a KV spirals in to a target in accordance with the present invention.
Figure 4:
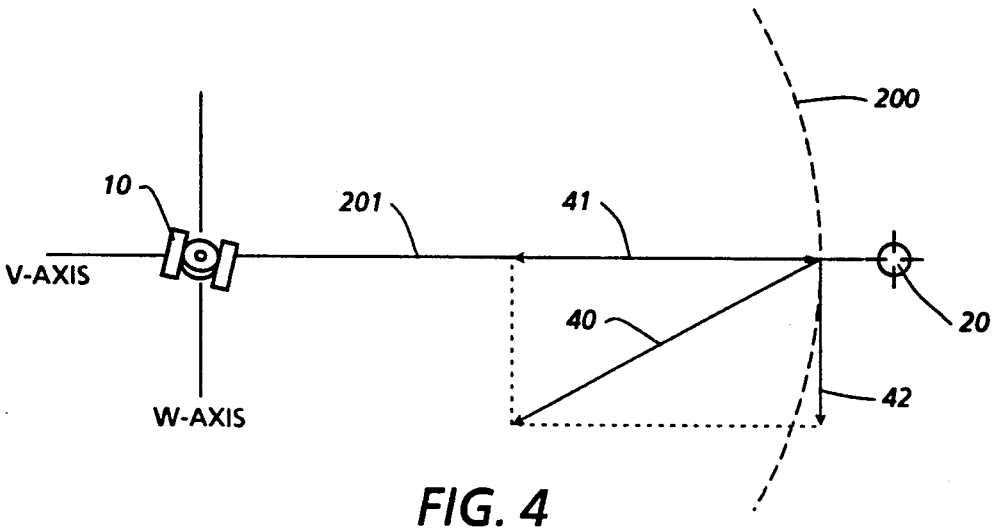
FIG. 4 depicts a V-W plane representation of how the total divert vector is instantaneously applied according to the present invention.

Specifically, KV 20 simply applies its total (unthrottled) thrust (in the case of a divert motor) about the relative position vector in the following manner. (Again note that the divert "thrust" may be developed by divert motors/rockets, either discrete or continuous in nature, or by aero surfaces on KV 20.) At any instant, the total thrust vector is directed in a plane that is parallel to the V-W plane. Accordingly, representation of total thrust vector 40 may be shown in the V-W plane representation of FIG. 4. In FIG. 4, target 10 resides at the origin and projected miss vector 201 extends out to intentional offset circle 200. Total thrust vector 40 is defined by components along both the V and W axes. The first component 41 of total thrust vector 40 is parallel to and opposite projected miss vector 201. The second component 42 of total thrust vector 40 is applied perpendicular to first component 41. First component 41 is the amount of divert (e.g., thrust) required to keep projected miss vector 201 on intentional offset circle 200 which decreases as KV 20 approaches target 10. Second component 42 is applied perpendicular to first component 41 in one of two possible directions to generate either a clockwise or counterclockwise spiral about the relative position vector. Since second component 42 is also perpendicular to the instantaneous projected miss vector 201, second component 42 does not affect the magnitude of projected miss vector 201. As an example, FIG. 5 shows a time lapse scenario in which the initial projected miss vector 201 is along the V-axis. As time progresses, projected miss vector 201 rotates in the V-W plane and decreases in magnitude as KV 20 spirals in toward target 10 along a spiral path shown by dotted line 300.

The advantages of the present invention are numerous. The present method is especially suited to KVs employing fixed-impulse, solid-fuel divert motors since the present invention does not require the throttling of divert motors during flight. The fixed-impulse, solid-fuel divert motors are free to burn at their predetermined rate, while their thrust direction is controlled during the terminal homing phase of flight. The present method can be used in conjunction with virtually any type of KV having divert capability. Such divert capability could be generated by solid or liquid-fuel divert motors, or KV-mounted aerosurfaces. The present guidance method also directs a KV on a spiral path such that the target range can be developed using measurements from an angle-only (passive) sensor. However, unlike other passive ranging techniques, the method is easy to implement and requires few computations thereby making it well suited for implementation by current KV guidance computers.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A method of guiding an in-flight vehicle, having course divert capability, toward an intercept with a target, comprising the steps of: acquiring locational data on said target using a sensing device mounted on said vehicle to establish a relative position vector between said vehicle and said target; selecting a course for said vehicle that is offset from a collision course with said target, said offset being determined by a projected miss vector originating from said target and lying in a plane perpendicular to said relative position vector, said projected miss vector having a magnitude based on a total thrust of the vehicle deliverable in accordance with said course divert capability thereof; and directing said total thrust in a direction determined by first and second orthogonal components thereof, said first component being parallel and opposite to said projected miss vector.

2. A method according to claim 1 wherein said course divert capability of the vehicle is provided by a single, solid-fuel divert motor.

3. A method according to claim 1 wherein said first and second components of the total thrust lie in a plane parallel to said plane perpendicular to said relative position vector.

4. A method of guiding an in-flight vehicle, having a single solid-fuel divert motor, toward an intercept with a target comprising the steps of: acquiring locational data on said target using a sensing device mounted on said vehicle to establish a relative position vector between said vehicle and said target; selecting a trajectory for said vehicle that is offset from a collision course with said target, said offset being in a plane perpendicular to said relative position vector and having a magnitude based on the capability of said divert motor to divert said trajectory of the vehicle; burning said divert motor to develop thrust; and directing said thrust parallel to said plane to reduce said offset and cause said trajectory of the vehicle to spiral around said relative position vector.

5. A method of guiding a vehicle in flight, comprising the steps of: exerting thrust on the vehicle during flight toward a target; acquiring locational data on said target from which a collision course is determined and a relative position vector established between the vehicle and the target; selecting a path of travel of the vehicle along a trajectory having an intentional offset from the collision course by an amount dependent on said thrust exerted on the vehicle during said flight thereof toward the target; and directionally controlling said thrust during said flight of the vehicle along said selected path of travel to reduce said intentional offset of the trajectory.

6. The method of claim 5 wherein said step of directionally controlling the thrust includes: directing a first component of the thrust toward a target within a target impact plane; and directing a second component of the thrust perpendicular to said target plane to cause spiraling of said vehicle about the relative position vector along said selected path of travel.

7. The method of claim 6 wherein said intentional offset of the trajectory is less than an offset limiting function of maximum acceleration of the vehicle (Akv) and duration (T) of a terminal homing phase during which the vehicle approaches the target along said selected path of travel.

8. The method of claim 7 wherein said limiting function equals $\int_{tc}^{tf}\int^{T} Akv(t)dtdT$, there (t) is time, (tc) denotes current time and (tf) denotes final time of the terminal homing phase.

9. The method of claim 5 wherein said intentional offset of the trajectory is less than an offset limiting function of maximum acceleration of the vehicle (Akv) and duration (T) of a terminal homing phase during which the vehicle approaches the target along said selected path of travel.

10. The method claim 9 wherein said limiting function equals $\int_{tc}^{tf}\int^{T} Akv(t)dtdT$, where (t) is time, (tc) denotes current time and (tf) denotes final time of the terminal homing phase.

* * * * *